US008443637B2

(12) United States Patent
Hedemark et al.

(10) Patent No.: US 8,443,637 B2
(45) Date of Patent: May 21, 2013

(54) INTERNAL ROTATABLE LOCK CYLINDER

(76) Inventors: Flemming Hedemark, Klampenborg (DK); Peder Lentz, Hillerod (DK); Palle Jul Larsen, Skaevinge (DK)

( * ) Notice: Subject to any disclaimer, the term of this patent is extended or adjusted under 35 U.S.C. 154(b) by 0 days.

(21) Appl. No.: 13/379,754

(22) PCT Filed: Jul. 5, 2010

(86) PCT No.: PCT/EP2010/003989
§ 371 (c)(1),
(2), (4) Date: Dec. 21, 2011

(87) PCT Pub. No.: WO2011/003546
PCT Pub. Date: Jan. 13, 2011

(65) Prior Publication Data

US 2012/0099925 A1 Apr. 26, 2012

(30) Foreign Application Priority Data

Jul. 10, 2009 (DK) ..... 2009 00849

(51) Int. Cl.
*E05B 67/36* (2006.01)

(52) U.S. Cl.
USPC ..... 70/34; 70/386; 70/14; 70/416; 42/70.07

(58) Field of Classification Search
USPC ..... 70/32–34, 386, 14, 416, 417; 42/70.07, 42/70.11
See application file for complete search history.

(56) References Cited

U.S. PATENT DOCUMENTS

| | | | | | |
|---|---|---|---|---|---|
| 4,398,366 | A | * | 8/1983 | Wernicki | 42/70.11 |
| 4,614,097 | A | * | 9/1986 | Signorelli | 70/34 |
| 4,712,400 | A | | 12/1987 | Steinbach | |
| 4,884,420 | A | * | 12/1989 | Finkel et al. | 70/58 |
| 4,946,130 | A | * | 8/1990 | Kooiman | 251/95 |
| 4,999,940 | A | * | 3/1991 | Madden | 42/70.11 |
| 5,664,445 | A | * | 9/1997 | Chang | 70/34 |
| 5,893,284 | A | * | 4/1999 | Hrabal | 70/358 |
| 5,934,000 | A | * | 8/1999 | Hayes, Sr. | 42/95 |

(Continued)

FOREIGN PATENT DOCUMENTS

| | | | |
|---|---|---|---|
| EP | 568 890 | A1 | 4/1993 |
| WO | WO 02/063232 | A1 | 8/2002 |
| WO | WO 03/098143 | A1 | 11/2003 |

*Primary Examiner* — Suzanne Barrett
(74) *Attorney, Agent, or Firm* — Kenneth L. Green

(57) ABSTRACT

There is provided a locking system having a lock bar and a lock cylinder, where the lock cylinder comprises an outer tube, an inner tube and securing means. The inner tube is placed inside the outer tube and has an opening for receiving a part of the lock bar, and the inner tube can rotate between a first and a second position relative to the outer tube corresponding to open and locked position of the locking system. The outer tube, the inner tube, the securing means and the lock bar are dimensioned so that when the inner tube is in the first position relative to the outer tube, then the securing means are in engagement with the outer tube and the inner tube, and the lock bar can be brought in and out of the inner tube, and when the inner tube is in the second position relative to the outer tube, then the securing means are in engagement with the inner tube and the lock bar, whereby the lock bar is securely locked to the inner tube, while at the same time the lock bar and the inner tube can rotate relative to each other. It is preferred that the securing means is made up of a number of locking balls.

17 Claims, 7 Drawing Sheets

U.S. PATENT DOCUMENTS

| | | | | |
|---|---|---|---|---|
| 5,960,653 | A * | 10/1999 | DeWalch et al. | 70/164 |
| 6,041,536 | A * | 3/2000 | Samuels et al. | 42/70.11 |
| 6,055,832 | A * | 5/2000 | Wyers | 70/34 |
| 6,442,881 | B1 * | 9/2002 | Kellerman | 42/70.11 |
| 6,526,684 | B1 * | 3/2003 | Hickerson | 42/70.11 |
| 6,543,171 | B2 * | 4/2003 | Kellerman | 42/70.11 |
| 6,543,260 | B2 * | 4/2003 | Koy et al. | 70/34 |
| 6,560,910 | B1 * | 5/2003 | McLaren | 42/70.11 |
| 6,604,313 | B1 | 8/2003 | Kress | |
| 6,679,090 | B1 | 1/2004 | Finch, Jr. | |
| 6,796,071 | B2 * | 9/2004 | Lane et al. | 42/70.11 |
| 6,813,918 | B2 * | 11/2004 | Reese | 70/386 |
| 6,851,285 | B1 * | 2/2005 | Haas | 70/26 |
| 6,854,302 | B2 * | 2/2005 | Zapushek et al. | 70/34 |
| 7,353,671 | B2 * | 4/2008 | Recknagel et al. | 70/34 |
| 7,698,916 | B2 * | 4/2010 | Davis | 70/34 |
| 2002/0152662 | A1 * | 10/2002 | Lane et al. | 42/70.11 |
| 2004/0064993 | A1 | 4/2004 | Klein | |
| 2007/0137266 | A1 * | 6/2007 | Hsai | 70/34 |

* cited by examiner

INTERNAL ROTATABLE LOCK CYLINDER

The present application claims the priority of Danish Patent Application Serial No. PA200900849 filed Jul. 10, 2009 and of PCT Application Serial No. PCT/EP2010/003989 filed Jul. 5, 2010, which applications are incorporated in their entirety herein by reference.

FIELD OF THE INVENTION

The invention relates to a locking system with a lock bar and a lock cylinder, where the lock bar can be securely locked to the lock cylinder, while at the same time the lock bar and the lock cylinder can rotate relatively to each other. The locking system can be dimensioned for locking shotguns and guns.

BACKGROUND OF THE INVENTION

According to Danish weapon legislation, weapons, which are not stored in a weapon cupboard, must be under constant surveillance. This means that everybody, who possesses a shotgun, which is not stored in a weapon cupboard, in principle must not leave their weapon.

Here some examples are mentioned, where it is common that a weapon is left without surveillance:

1. When a person leaves his shotgun "outside" on the shooting range, which can happen both before and after shooting.
2. When a hunter is on his way to hunt or on his way back home from hunt and will go for shopping or for toilet.
3. When hunters go for lunch or the like and leave their weapon outside a cottage or in the cars.

It is an aim of the present invention to provide a locking system, which can give a solution to the above-mentioned problems concerning locking of shotguns. It is furthermore an aim to provide a locking system, which can be used in other places, where there is need for a kind of locking.

SUMMARY OF THE INVENTION

According to the present invention there is provided a locking system comprising:

a lock bar;

a lock cylinder with an outer tube, an inner tube and securing means;

wherein the inner tube is placed inside the outer tube and has an opening for receiving a part of the lock bar, wherein the inner tube can rotate between a first and a second position relative to the outer tube corresponding to open and locked position of the locking system, and wherein the outer tube, the inner tube, the securing means and the lock bar are dimensioned so that when the inner tube is in the first position relative to the outer tube, then the securing means are in engagement with the outer tube and the inner tube, and the lock bar can be brought in and out of the inner tube, and when the inner tube is in the second position relative to the outer tube, then the securing means are in engagement with the inner tube and the lock bar, whereby the lock bar is securely locked to the inner tube, while at the same time the lock bar and the inner tube can rotate relative to each other.

It is preferred that the securing means is made up of a number of locking balls. In a preferred embodiment of the invention, the locking system is further characterised in that the lock bar is round and has a number of grooves for receiving locking balls, said bar grooves extending all the way round the lock bar;

the inner tube has an oblong opening for receiving a part of the lock bar with grooves, said inner tube having a number of through-going bores, which bores are positioned so to face corresponding grooves on the lock bar when the lock bar is placed in the inner tube, the locking balls are placed in the bores of the inner tube, and the outer tube has a number of grooves for receiving the locking balls, which outer tube grooves are positioned and formed so that when the inner tube is in the first position relative to the outer tube, which corresponds to an open locking system, then the locking balls can be stored partly in the grooves of the outer tube and partly in the bores of the inner tube without reaching into the opening of the inner tube facing the lock bar, and when the inner tube is rotated a certain number of degrees to reach the second position relative to the outer tube, which corresponds to a locked locking system, then the locking balls are pushed totally or partly out from the grooves of the outer tube, so that the locking balls are stored partly in the bores of the inner tube and partly in the grooves of the lock bar, whereby the lock bar is securely locked to the inner tube, while at the same time the lock bar and the inner tube can rotate relative to each other.

Thus, the present invention also covers a locking system comprising:

A round lock bar having a number of grooves for receiving locking balls, said bar grooves extending all the way round the lock bar;

a lock cylinder with an outer tube, an inner tube, and a number of locking balls, wherein the inner tube is placed inside the outer tube and has an oblong opening for receiving a part of the lock bar with grooves, said inner tube having a number of through-going bores, which bores are positioned so to face corresponding grooves on the lock bar when the lock bar is placed in the inner tube, wherein the locking balls are placed in the bores of the inner tube, and wherein the outer tube has a number of grooves for receiving the locking balls, which outer tube grooves are positioned and formed so that when the inner tube is in the first position relative to the outer tube, which corresponds to an open locking system, then the locking balls can be stored partly in the grooves of the outer tube and partly in the bores of the inner tube without reaching into the opening of the inner tube facing the lock bar, and when the inner tube is rotated a certain number of degrees to reach the second position relative to the outer tube, which corresponds to a locked locking system, then the locking balls are pushed totally or partly out from the grooves of the outer tube, so that the locking balls are stored partly in the bores of the inner tube and partly in the grooves of the lock bar, whereby the lock bar is securely locked to the inner tube, while at the same time the lock bar and the inner tube can rotate relative to each other.

In a preferred embodiment the locking system further has a lock, which is placed inside a first end of the outer tube and secured to this end, while the inner tube is placed in the opposite end of the outer tube, and the lock is in engagement with the inner tube, so that the inner tube can rotate a certain number of degrees relative to the outer tube when the lock is rotated accordingly.

It is preferred that the bores of the inner tube are formed so that the locking balls only partly can reach through the bores and the opening of the inner tube facing the lock bar. It is also preferred that for each bore of the inner tube there is a corresponding groove in the outer tube and a corresponding groove in the lock bar, and that there is a locking ball for each bore of the inner tube.

The system according to the present invention also covers an embodiment, wherein there are several bores in the inner tube, which bores may be positioned lengthwise after each other. According to an embodiment there are 3 locking balls and 3 corresponding bores in the inner tube. It is also within an embodiment of the invention that the outer tube further has a number of through-going bores of a size so that the locking balls can pass through, said outer tube bores being arranged so that the bores of the inner tube by a rotation of the inner tube can be brought in a position facing the bores of the outer tube, whereby the locking balls can be placed in the bores of the inner tube.

According to an embodiment of the invention the grooves of the lock bar are formed in a first end of the lock bar, and the lock bar has a device for adjusting the length of the lock bar. The lock bar may consist of a first and a second part, which parts are kept together by an adjustment piece. Here, both the first and the second part of the lock bar may in one end be provided with an external thread, and the adjustment piece may be provided with corresponding internal threads, whereby the length of the lock bar can be adjusted by rotation of the adjustment piece. It is preferred that counter nuts are placed on the thread ends of the first and second parts of the lock bar for counter tightening of the adjustment piece. According to an embodiment one or more hardened, rotatable pieces of tube are mounted outside the lock bar.

The system according to the present invention also covers an embodiment, wherein the lock bar has an end stud in the end being most distant to the cylinder lock, which end stud has a diameter being larger than the diameter of the lock bar.

According to an embodiment of the invention the locking system is made so that the lock bar is dimensioned for fitting into the barrel of a shotgun and to be entered from the muzzle end of the barrel, and the lock cylinder is dimensioned to fit into the cartridge chamber of the shotgun.

EMBODIMENTS OF THE INVENTION

Figure 1:
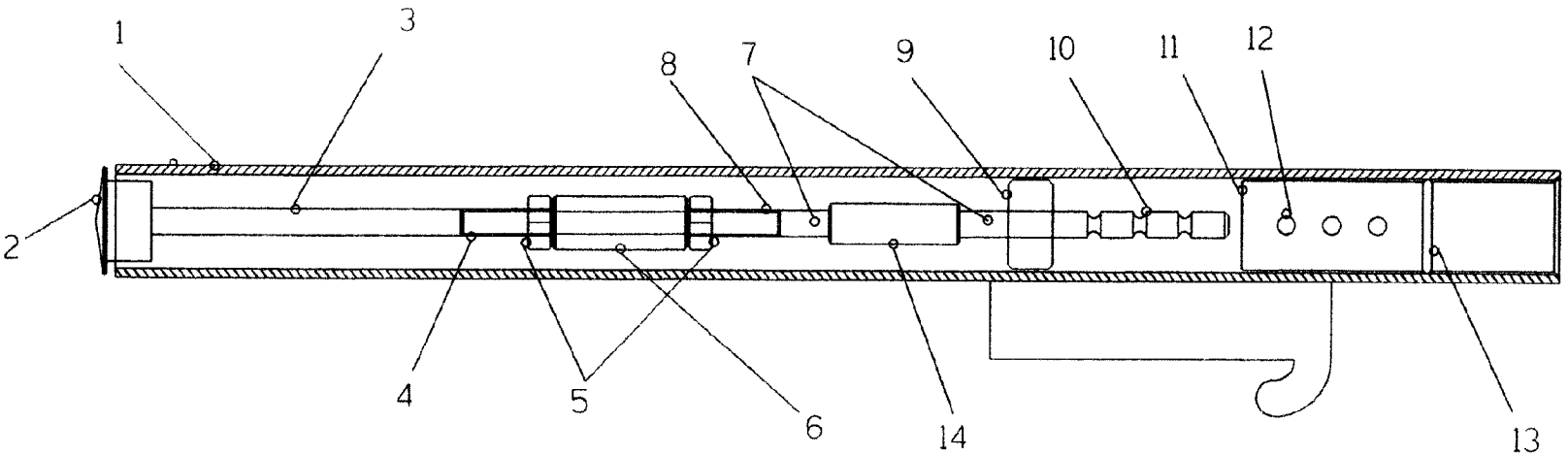
FIG. 1 shows a locking system according to a first embodiment of the invention, where the locking system comprises a lock cylinder and a lock bar and where the locking system is used for locking a barrel of a shotgun.

FIG. 1 shows a locking system according to a first embodiment of the invention, where the locking system is used for locking a barrel 1 of a shotgun. In FIG. 1 the barrel of the shotgun 1 is shown hatched. The locking system has a lock cylinder 11, which in FIG. 1 is placed in the cartridge chamber of the shotgun, and there is an O-ring 13 round the lock cylinder for protection of the cartridge chamber. The lock cylinder in FIG. 1 has three bores 12 to be used for entering locking balls into the lock cylinder 11. The lock cylinder is further described in connection with FIG. 2. The locking system of FIG. 1 further has a lock bar, which is entered from the muzzle end of the barrel 1 and extends all through the barrel in order to be locked to the lock cylinder 11 in the cartridge chamber. The lock bar has a first part 7 and a second part 3, where the first and the second parts 7, 3 are kept together by an adjustment piece 6, which here is an oblong nut having an internal M6 thread. The two ends of the first and the second parts 7, 3, which are facing the adjustment piece 6, each has a corresponding external thread 8, 4. There are furthermore two counter nuts 5 having M6 thread for counter tightening of the adjustment piece 6. By adjusting the adjustment piece 6 the lock bar may be fitted to a great number of shotgun barrels 1.

The outer end of the second part 3 of the lock bar of FIG. 1 is provided with an end stud or tightening pawl 2, which is made of a hardened material, and which has an outer diameter being larger than the diameter of the lock bar and larger than the inner diameter of the shotgun barrel 1. It is preferred that the end stud 2 has a top angel of about 30 degrees, which can prevent drilling, and it is also preferred that the outer diameter of the end stud corresponds to the outer diameter of the shotgun barrel. A hardened piece of tube 14 is mounted on the first part 7 of the lock bar. This piece of tube is rotatable around the lock bar and functions as a rotating protection of the lock bar, for example if there is an attempt to saw off the lock bar. In FIG. 1 there is shown only one piece of tube 14, but it is preferred that the parts of the lock bar, which are free from the adjustment piece 6 and nuts 5, are protected by corresponding pieces of tube. The outer end of the first part 7 of the lock bar is provided with three grooves 10, which extend all the way round the lock bar and which are formed so that they fit for receiving a part of a locking ball. The lock bar of FIG. 1 is furthermore provided with a guiding bushing or sleeve 9 for protection of the shotgun barrel 1.

The system shown in FIG. 1 is in its open or unlocked condition since the lock cylinder has to be pushed over the grooves 10 and brought in engagement with these in order to bring the system in its locked condition.

Figure 2:
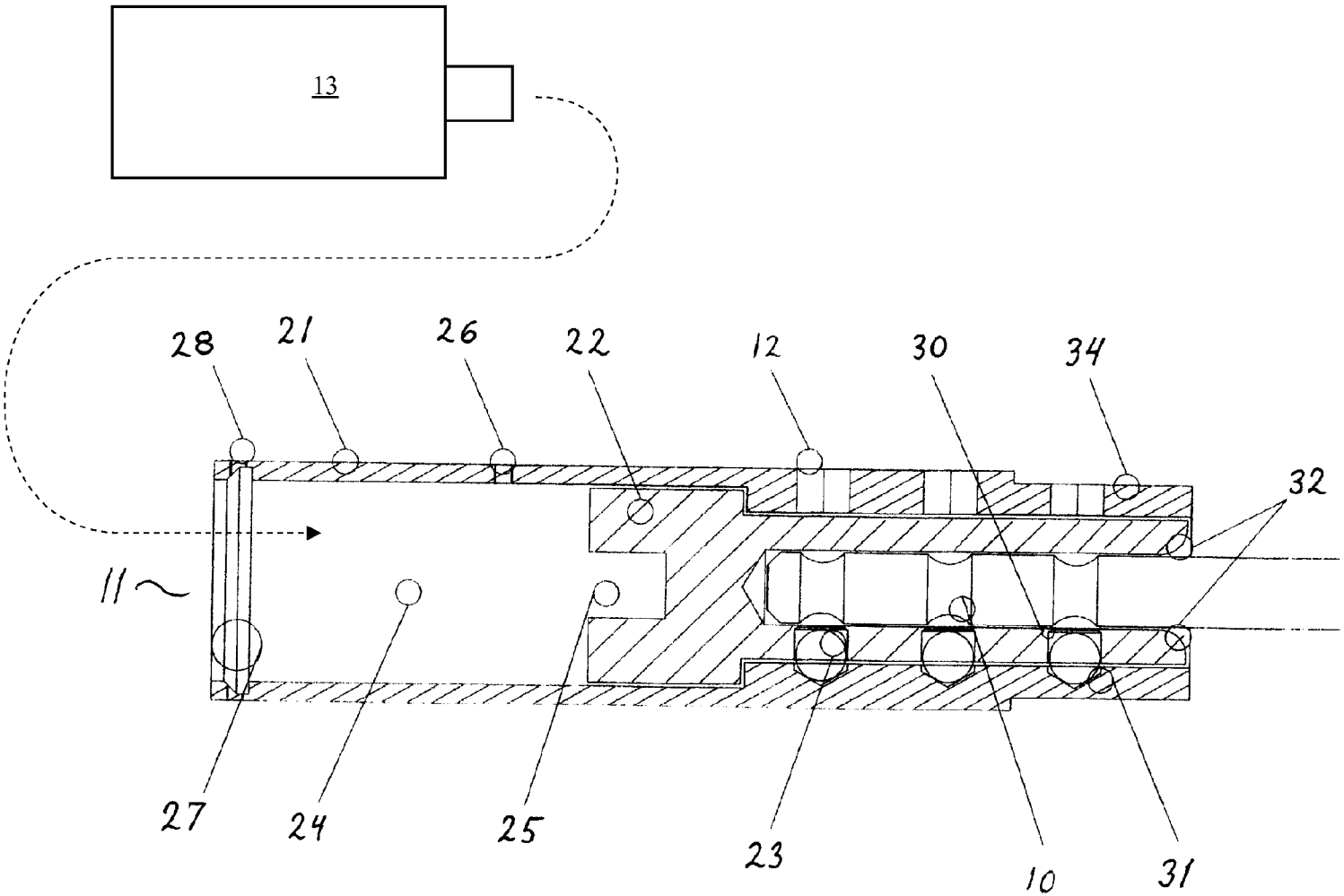
FIG. 2 is a cross sectional view of a lock cylinder according to an embodiment of the invention, where the lock cylinder can be used for the locking system shown in FIG. 1, and where the lock cylinder is shown in open or unlocked condition.

FIG. 2 is a cross sectional view of a lock cylinder 11 according to an embodiment of the invention, where the lock cylinder 11 can be used for the locking system shown in FIG. 1, and where the lock cylinder is shown in open or unlocked condition. The lock cylinder of FIG. 2 has an outer tube 21, an inner tube 22, and three locking balls 23. In order to lock the lock cylinder there must be a lock 13, and which may be a standard type lock, and the lock 13 may be placed in one end 24 of the outer tube 21. The outer tube 21 and the inner tube 22 are formed so that when the inner tube 22 is brought into the outer tube 21 from the lock end, then the inner tube 22 cannot be brought out through the other end of the outer tube 21, which end corresponds to the end from which the lock bar is brought in contact with the lock cylinder. The inner tube 22 has a notch 25, which fits to a corresponding dowel or pin on the used lock, and when the lock is brought in engagement with the notch 25, the lock is secured to the outer tube 21 by use of a screw 26 (here an M2 Allen key pointed screw is used). When the lock is secured in the outer tube 21, a lock cover 27 is mounted at the end of the outer tube 21 by two screws 28 (here two M2×2 Allen key screws are used).

The inner tube 22 has an opening for receiving the part of the lock bar having grooves 10. In FIG. 2 the lock bar is brought into the inner tube 22, and the inner tube has three bores 30, which are positioned so to face corresponding grooves 10 on the lock bar (corresponding to the grooves 10 in FIG. 1). The bores 30 have a height, which is lesser than the diameter of a locking ball 23, and a width, which fits to the locking balls 23 being placed in the bores 30. The bores 30 are formed so that the balls 23 can only partly reach through the opening of the inner tube facing the grooves 29 of the lock bar. The inner tube 22 of FIG. 2 is rounded 32 at the end from which the lock bar is brought in.

The outer tube 21 has three grooves 31 for receiving locking balls 23. These grooves 31 are placed so that the bores 30 of the inner tube can be brought in a position opposite to the grooves 31. The grooves 31 have a depth so that less than half of a ball 23 is received in a groove 31. In this way a ball 23, which is stored partly in a groove 31 and in a bore 30, will be pushed out of the groove 31 if the inner tube 12 and thereby the bore 30 is rotated. When the ball is pushed out from the groove 31 a part of the ball 23 will reach into the opening of the inner tube 22 and thereby lock the lock bar to the inner tube 22, while at the same time the lock bar and the inner tube 22 can rotate relative to each other, as the grooves 29 extend all the way round the lock bar.

Thus, the locking system works as follows: when the inner tube 22 is in a first position relative to the outer tube 21 corresponding to an open locking system, then the locking balls 23 can be stored partly in the grooves 31 of the outer tube and partly in the bores 30 of the inner tube without reaching into the opening of the inner tube 22 facing the lock bar, and when the inner tube 22 is rotated a certain number of degrees (here 45 degrees are preferred) to a second position relative to the outer tube 21 corresponding to a locked locking system, then the locking balls 23 are pushed out from the grooves of the outer tube 31, so that the locking balls 23 are stored partly in the bores 30 of the inner tube and partly in the grooves 29 of the lock bar, whereby the lock bar is locked to the inner tube 22, while at the same time the lock bar and the inner tube can rotate relative to each other.

The outer tube 21 is provided with three bores 12 (corresponding to the bores 12 in FIG. 1) to be used for entering locking balls 23 into the bores 30 of the inner tube. This requires that the inner tube 22 is rotated so that the bores 30 are in a position facing the bores 12. The bores 12 can be closed when the balls 23 are entered.

The outer tube 21 further has an outer groove 34 in the end facing the lock bar, which may be of importance when fitting the locking system to different types of shotguns.

The illustrated lock cylinder 11 has three locking balls 23 arranged in a row after each other, but the present invention also covers systems, where there are fewer or more locking balls, such as 1, 2, 4, 5, 6 or more locking balls. Likewise it is not necessary that the balls 23 are arranged in a row after each other. There may also be two or three sets of bores 30 in the inner tube 22 with corresponding grooves 31 in the outer tube and a corresponding number of locking balls 23. This will cause more balls 23 per groove 29 in the lock bar, and the more balls 23, the stronger locking.

Figure 3:
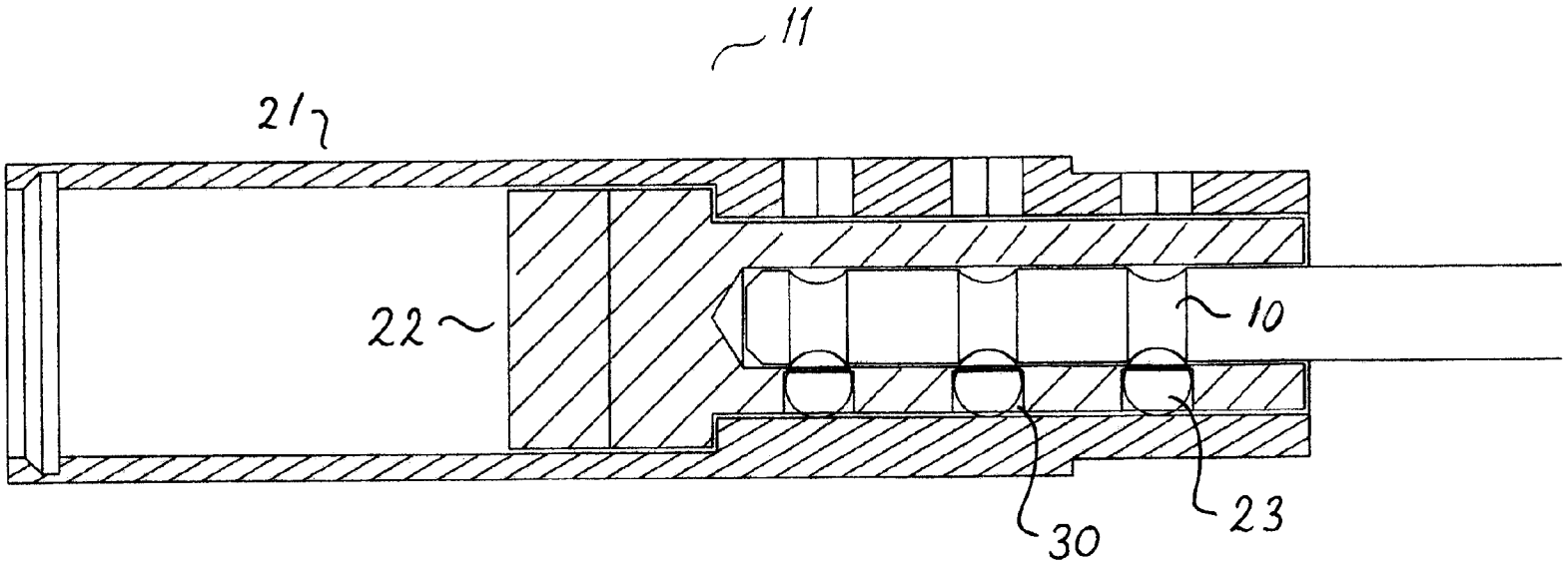
FIG. 3 is a cross sectional view of the lock cylinder of FIG. 2, but now in locked condition.

FIG. 3 is a cross sectional view of the lock cylinder 11 of FIG. 2, but now in locked condition. For the lock cylinder of FIG. 3 the inner tube 22 is in the second position relative to the outer tube 21, and it is seen that the locking balls 23 are pushed out from the grooves 31 of the outer tube 21, so that the locking balls 23 are stored partly in the bores 30 of the inner tube and partly in the grooves 29 of the lock bar, whereby the lock bar is locked to the inner tube 22, while at the same time the lock bar and the inner tube 22 can rotate relative to each other.

Figure 4:
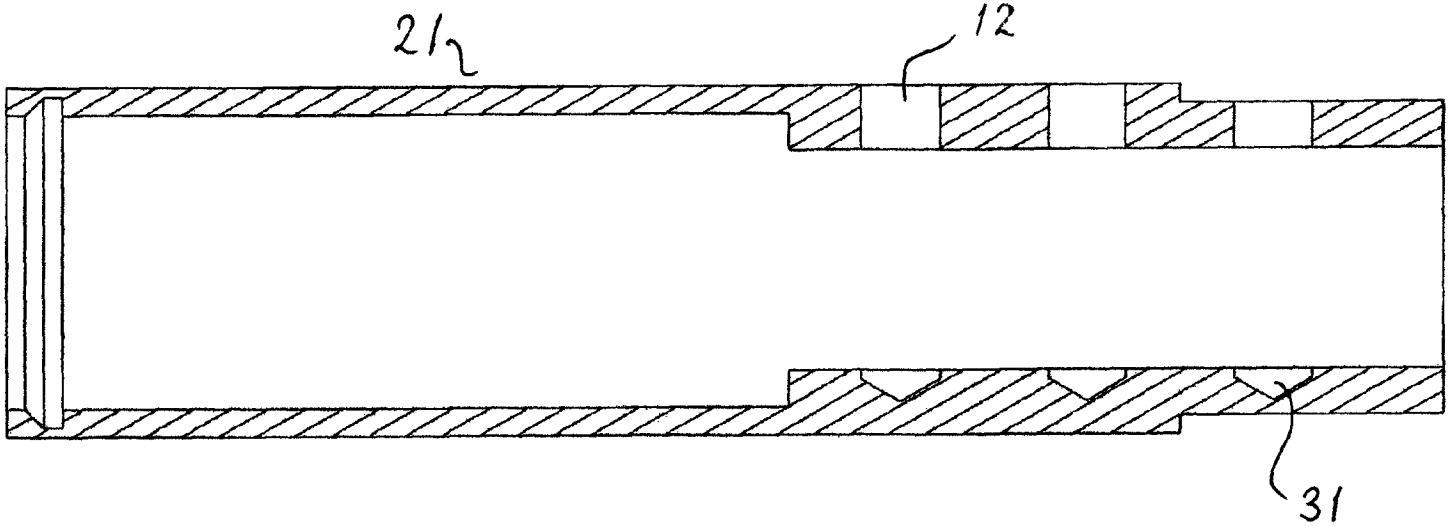
FIG. 4 is a cross sectional view of an outer tube for use in the lock cylinder of FIG. 2.

FIG. 4 is a cross sectional view of an outer tube 21 for use in the lock cylinder 11 of FIG. 2. The outer tube 21 has grooves 31 for partly receiving the locking balls 23, and bores 12 to be used for entering the locking balls 23 into the inner tube 22. Here, the bores are placed opposite the grooves 31.

Figure 5:
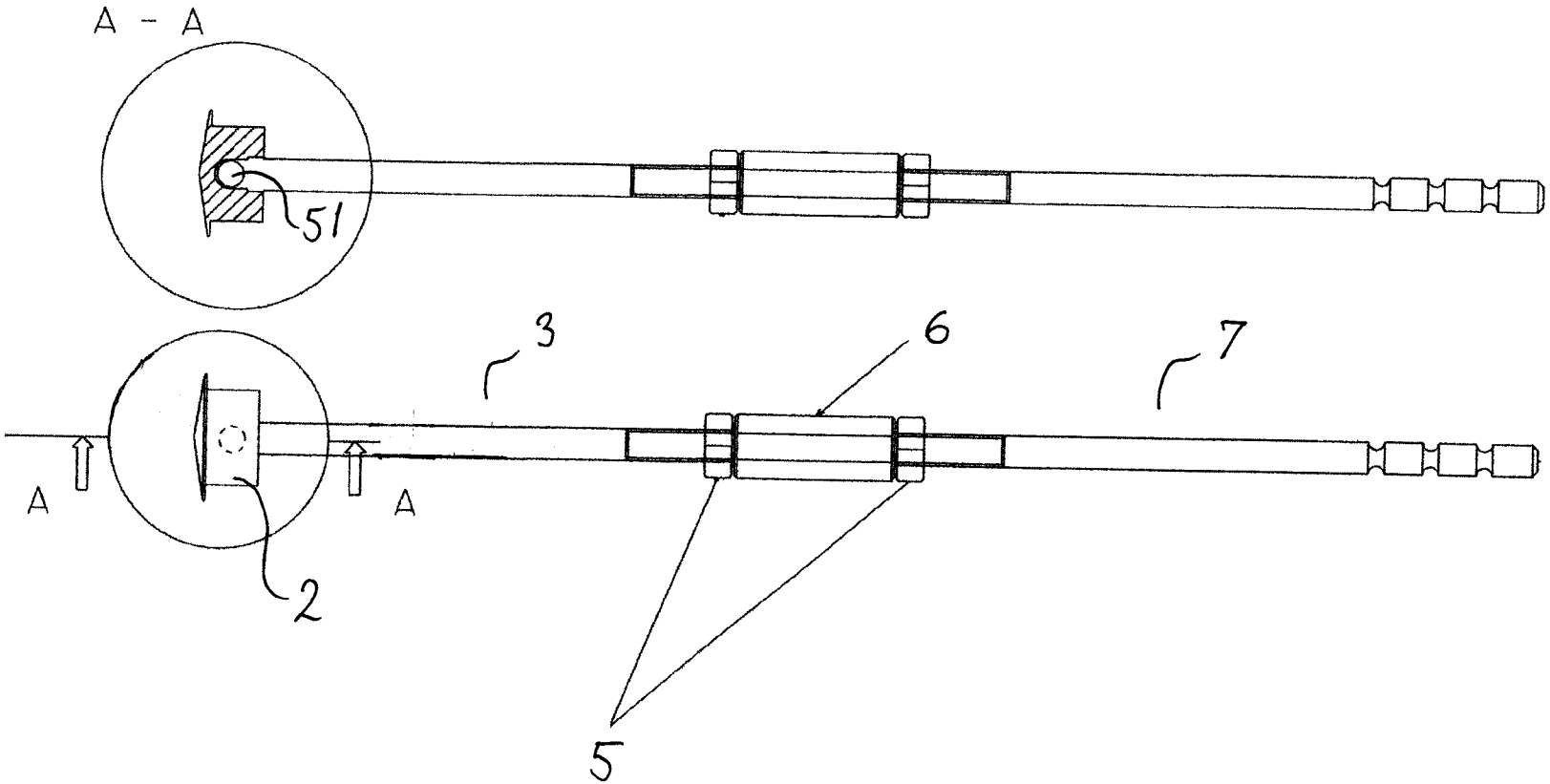
FIG. 5 shows a lock bar with an end stud according to an embodiment of the invention, where the lock bar may be used in the locking system shown in FIG. 1.

FIG. 5 shows a lock bar with an end stud according to an embodiment of the invention, where the lock bar may be used in the locking system shown in FIG. 1. For the lock bar in FIG. 5 there is an extra ball safeguarding 51 at the end of the lock bar where the end stud/tightening pawl 2 is mounted to the lock bar, which will further complicate drilling. The lock bar of FIG. 5 has a first and second part 7,3 being kept together by an adjustment piece 6, and two counter nuts 5 for counter tightening the adjustment piece 6.

Figure 6:
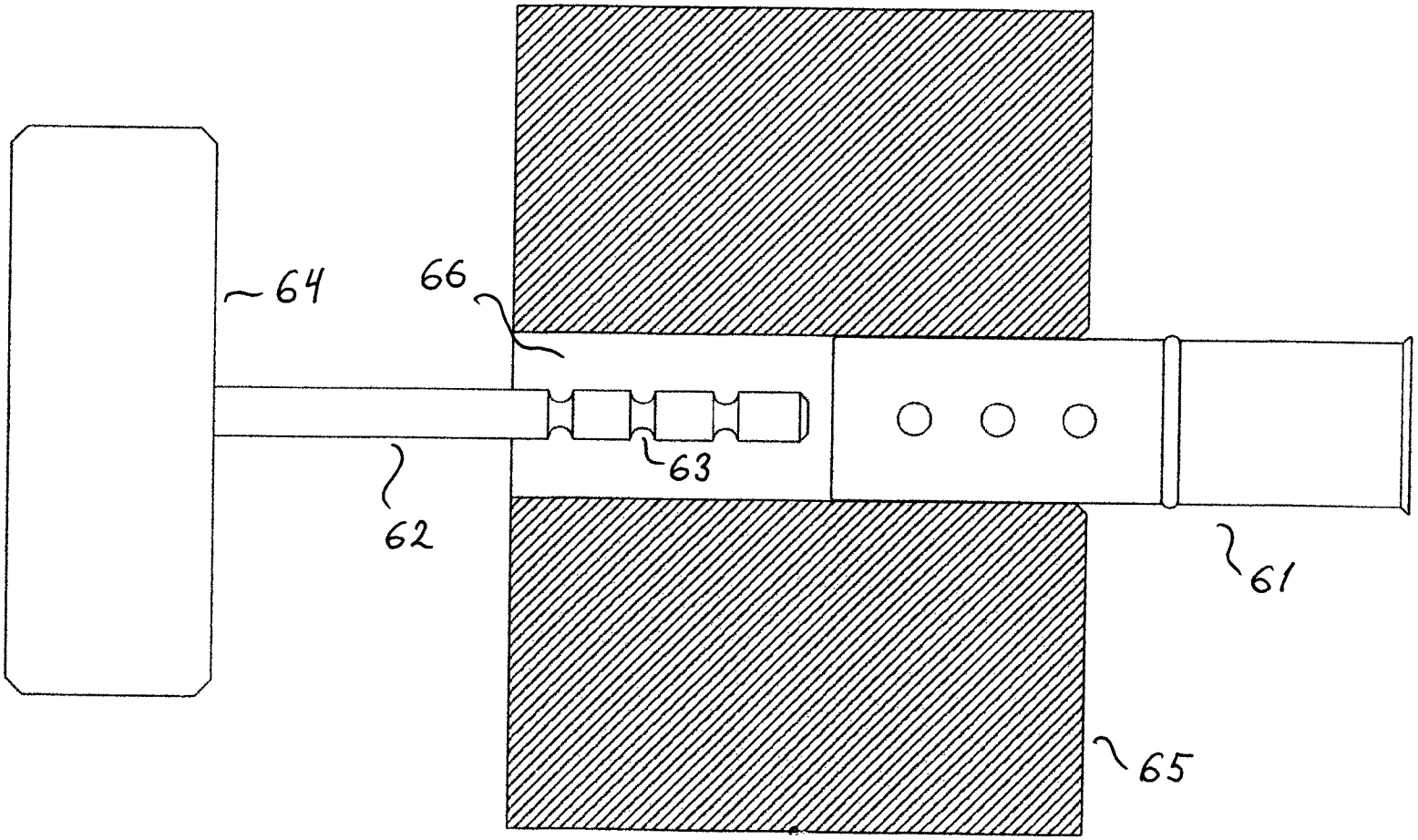
FIG. 6 shows a locking system according to a second embodiment of the invention, where the locking system comprises a lock cylinder and a lock bar, and where the locking system is used for locking a gate or the like, and FIGS. 7*a* and 7*b* show a locking system according to a third embodiment of the invention, where the locking system comprises a lock cylinder and a lock bar, and where the locking system is used as a wall lock providing a locked cavity.

FIG. 6 shows a locking system according to a second embodiment of the invention, where the locking system comprises a lock cylinder and a lock bar, and where the locking system is used for locking a gate or the like. The locking system comprises a lock cylinder 61 as described above in connection with FIG. 2, but the lock bar 62 is much shorter than the lock bar described in connection with FIG. 1. The lock bar 62 in FIG. 6 partly corresponds to the first part 7 of the lock bar of FIG. 1, and the lock bar 62 in FIG. 6 is therefore, in the end facing the lock cylinder 61, provided with grooves 63 for receiving a part of the locking balls in the lock cylinder 61. In the other end the lock bar 62 can be secured for example to a wall 64, to which a door or gate 65 is to be locked. Locking then takes place in that the door or gate has a lock hole 66, in which the lock bar 62 is introduced from one side, and where the lock cylinder 62 is introduced from the other side, whereupon the lock cylinder 62 can be brought into locked condition in relation to the lock bar 61.

Figure 7A:
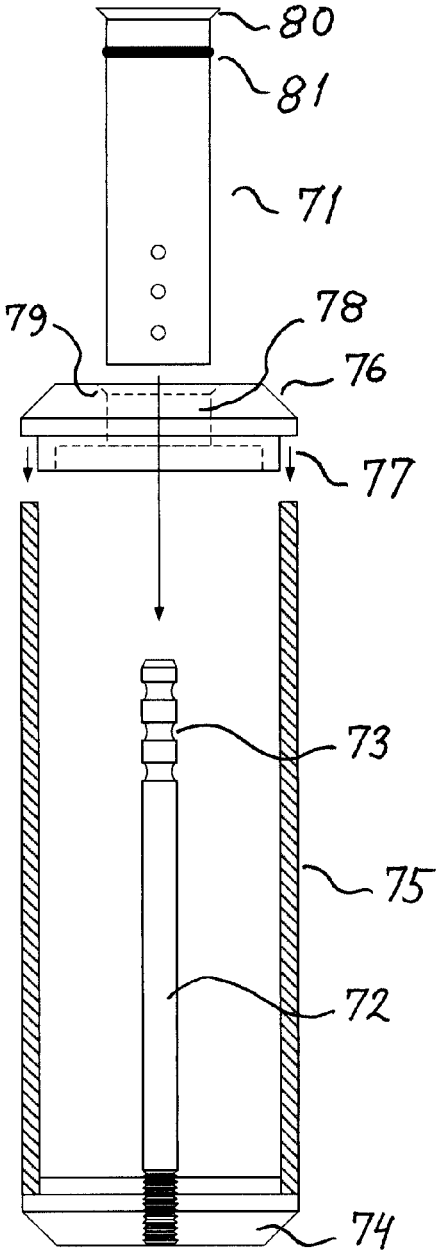
Figure 7B:
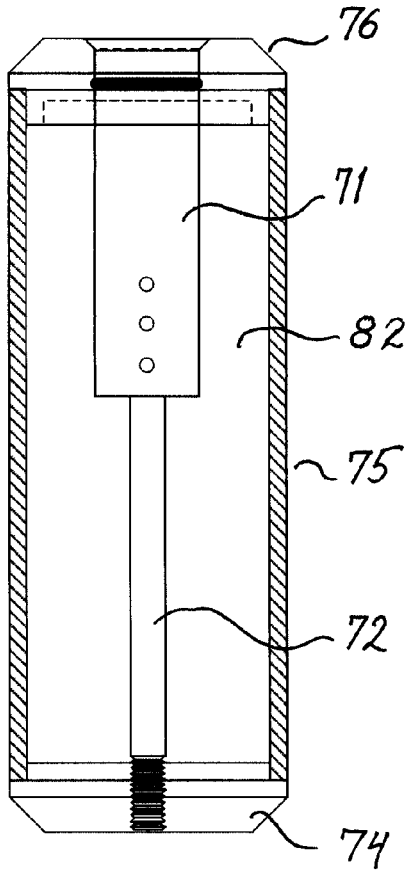

FIGS. 7*a* and 7*b* show a locking system according to a third embodiment of the invention, where the locking system comprises a lock cylinder and a lock bar, and where the locking system is used as a wall lock providing a locked cavity, which for example can be used as a safe storage for a key. FIG. 7*a* shows the system in un-locked condition, and FIG. 7*b* shows the system in locked condition. The locking system comprises a lock cylinder 71 as described above in connection with FIG. 2, a lock bar 72 with grooves 73, a bottom part 74, a tube part 75, and an outer lid 76. The lock bar 72 is much shorter than the lock bar described in connection with FIG. 1, and the lock bar 72 in FIG. 7 partly corresponds to the first part 7 of the lock bar of FIG. 1, with the end of the lock bar 72 having grooves 73 for receiving a part of the locking balls in the lock cylinder 71. In the other end the lock bar 72 is secured to the bottom part 74, which again can be mounted in a wall. The lock bar 72 may for example be secured to the bottom part 74 by use of a lock nut. The tube part 75 is secured to the bottom part, and both the bottom part 74 and the tube part 75 may be mounted in a wall, thereby providing a cavity in the wall. The outer lid 76 is formed so that the lower part 77 fits into the tube part 75, and the outer lid 76 has an opening 78, which fits to the lock cylinder 71. The opening 78 has a recess 79 fitting to a projection end part 80 of the lock cylinder 71. The lock cylinder 71 preferably also has an O-ring 81, and by inserting the lock cylinder 71 into the opening 78 of the lid 76, the lid 76 may now be locked to the tube part 75 by locking the lock cylinder 71 to the lock bar 72 as shown in FIG. 7*b*, thereby providing a locked cavity 82. While the lid 76 is locked to the tube part 75 is may still be able to rotate relative to the tube part 75, and may thus rotate together with the lock cylinder 71.

It is preferred that a hardened steel material, such as for example Arne steel, is used in manufacturing the different parts of the locking system.

Use of the locking system in connection with locking of a shotgun, FIG. 1.

When locking a shotgun the lock cylinder 11 is mounted in the cartridge chamber, where the lock cylinder 11 is secured by the O-ring 13. Hereafter the lock bar is mounted from the muzzle end of the barrel, the lock bar is pushed into the lock cylinder 11 and the lock bar is locked to the lock cylinder. The locking system is now connected, and an adjustment of the length of the lock bar can be performed. The adjustment of the length takes place by measuring the additional distance from the barrel end to the end stud, whereupon the lock bar is unlocked and withdrawn, and the length of the lock bar is now shortened by the additional distance by rotation of the adjustment piece.

The invention claimed is:

1. A locking system comprising:

a lock bar having an inserted end having a number of ball grooves for receiving locking balls, said bar grooves extending all the way round the lock bar;

a lock cylinder with an outer tube, an inner tube, and a number of the locking balls, wherein the inner tube is placed inside the outer tube and has an opening for receiving the inserted end of the lock bar with grooves, said inner tube having a number of permanent and fixed through-going bores, which bores are positioned so to face corresponding grooves on the lock bar when the lock bar is placed in the inner tube, wherein the inner tube can rotate between a first and a second position relative to the outer tube corresponding to open and locked position of the locking system;

wherein the locking balls are placed in the bores of the inner tube; and wherein the outer tube has a number of permanent and fixed outer tube grooves for receiving the locking balls, which outer tube grooves are positioned and formed so that when the inner tube is in the first position relative to the outer tube, which corresponds to an open locking system, then the locking balls can be stored partly in the grooves of the outer tube and partly in the bores of the inner tube without reaching into the opening of the inner tube facing the lock bar, and when the inner tube is rotated a certain number of degrees to reach the second position relative to the outer tube, which corresponds to a locked locking system, then the locking balls are pushed totally or partly out from the grooves of the outer tube, so that the locking balls are stored partly in the bores of the inner tube and partly in the grooves of the lock bar, whereby the lock bar is securely locked to the inner tube, while at the same time the lock bar and the inner tube can rotate relative to each other.

2. A locking system according to claim 1, wherein the lock cylinder furthermore has a lock, which is placed inside a first end of the outer tube and secured to the first end, and the lock is in engagement with the inner tube, so that the inner tube can rotate a certain number of degrees relative to the outer tube when the lock is rotated accordingly.

3. A locking system according to claim 1, wherein the bores of the inner tube are formed so that the locking balls only partly can reach through the bores and the opening of the inner tube facing the lock bar.

4. A locking system according to claim 1, wherein for each bore of the inner tube there is a corresponding groove in the outer tube and a corresponding groove in the lock bar, and wherein there is a locking ball for each bore of the inner tube.

5. A locking system according to claim 1, wherein there are several bores in the inner tube, which bores are positioned lengthwise after each other.

6. A locking system according to claim 1, wherein the lock bar comprises a first and a second part, which parts are kept together by an adjustment piece for adjusting the length of the lock bar.

7. A locking system according to claim 1, wherein one or more hardened, rotatable pieces of tube are mounted outside the lock bar.

8. A locking system according to claim 1, wherein the lock bar has an end stud in the end being most distant to the cylinder lock, which end stud has a diameter being larger than the diameter of the lock bar.

9. A locking system according to claim 1, wherein the outer tube includes tube bores alignable with the through-going bores of the inner tube allowing entering the locking balls into the lock cylinder.

10. A locking system according to claim 1, wherein the outer tube is a single piece having the permanent fixed grooves.

11. A locking system according to claim 1, wherein the lock bar includes an end stud on an exposed end opposite the inserted end, the exposed end stud having an outer diameter larger than the diameter of the lock bar and larger than the inner diameter of the shotgun barrel.

12. A locking system according to claim 11, wherein the end stud has a top angle of about 30 degrees.

13. A locking system according to claim 11, wherein a ball is imbedded in the end stud to make drilled difficult.

14. A locking system according to claim 1, wherein the grooves in the outer tube have a depth so that less than half of locking ball is received in a groove.

15. A locking system according to claim 1, wherein outer tube grooves, the bores, and the locking bar grooves comprise three sets of alignable longitudinally spaced apart outer tube grooves, inner tube bores, and locking bar grooves.

16. A locking system comprising:

a lock bar having:

an inserted end having a number N of longitudinally spaced apart circumferential bar grooves, said bar grooves extending all the way round the lock bar; and an exposed end opposite the inserted end, an exposed end stud having an outer diameter larger than the inner diameter of the shotgun barrel residing at the exposed end;

a lock cylinder comprising:

N locking balls;

a single piece outer tube defining a stepped inner bore having a larger diameter portion and a smaller diameter portion, N longitudinally spaces apart permanent inner grooves formed on an inner surface of the smaller diameter portion, the inner grooves having a depth so that less than half of locking ball is receivable into the inner grooves; and an inner tube having a stepped outer surface defining a second larger diameter portion and a second small diameter portion and N permanently formed longitudinally spaced apart radially extending bores extending through the second smaller diameter portion of the inner tube, the step positioning the inner tube within the outer tube to align the bores though the inner tube with the grooves in the outer tube, wherein:

the inner tube resides inside the outer tube and has an opening for receiving the inserted end of the lock bar, the bores of the inner tube positioned to align with corresponding bar grooves when the lock bar is residing in the inner tube;

the inner tube rotatable between:

a unlock position wherein the bores of the inner tube are aligned with the grooves of the outer tube and the locking balls may enter partially into the outer tube; and a locked position relative to the outer tube wherein the bores of the inner tube are not aligned with the grooves of the outer tube and the locking balls are forced to partially enter the bar grooves of the lock bar.

17. A locking system comprising:

a lock bar having:

an inserted end having a number N of longitudinally spaced apart circumferential bar grooves, said bar grooves extending all the way round the lock bar; and an exposed end opposite the inserted end, an exposed end stud having an outer diameter larger than the inner diameter of the shotgun barrel residing at the exposed end, a lock cylinder comprising:

N locking balls;

a single piece outer tube defining a stepped inner bore having a larger inner diameter portion and a smaller inner diameter portion, N longitudinally spaced apart permanent inner grooves formed on an inner surface of the smaller inner diameter portion, the inner grooves having a depth so that less than half of the locking ball is receivable into the inner groove, and the outer tube including longitudinally spaced apart tube bores having a same spacing as the inner grooves and allowing entering the locking balls into the lock cylinder; and an inner tube having and a stepped outer surface defining a larger outer diameter portion and a smaller outer diameter portion and N permanently formed longitudinally spaced apart radially extending bores extending through the smaller outer diameter portion of the inner tube, the step positioning the inner tube within the outer tube to align the bores though the inner tube with the inner grooves in the outer tube, wherein:

the inner tube resides inside the outer tube and has an opening for receiving the inserted end of the lock bar, the bores of the inner tube and inner grooves of the outer tube positioned to align with corresponding bar grooves when the lock bar is residing fully in the inner tube;

the inner tube rotatable between:

an unlock position wherein the bores of the inner tube are aligned with the inner grooves of the outer tube and the locking balls may enter partially into the outer tube; and a locked position relative to the outer tube wherein the bores of the inner tube are not aligned with the inner grooves of the outer tube and the locking balls are forced to partially enter the bar grooves of the lock bar.

* * * * *